United States Patent [19]

Olofsson

[11] Patent Number: 4,822,257

[45] Date of Patent: Apr. 18, 1989

[54] PUMP ARRANGEMENT, PARTICULARLY FOR PUMPING WATER FROM DEEP WELLS

[76] Inventor: Björn Olofsson, Mångatan 44, S-195 00 Märsta, Sweden

[21] Appl. No.: 101,297

[22] PCT Filed: Jan. 15, 1987

[86] PCT No.: PCT/SE87/00013

§ 371 Date: Aug. 31, 1987

§ 102(e) Date: Aug. 31, 1987

[87] PCT Pub. No.: WO87/04498

PCT Pub. Date: Jul. 30, 1987

[30] Foreign Application Priority Data

Jan. 16, 1986 [SE] Sweden ..... 8600190
May 16, 1986 [SE] Sweden ..... 86002244

[51] Int. Cl.[4] ..... F04B 43/10; F04B 47/04
[52] U.S. Cl. ..... 417/389
[58] Field of Search ..... 417/383, 385, 386, 387, 417/388, 389

[56] References Cited

U.S. PATENT DOCUMENTS

| | | | |
|---|---|---|---|
| 3,065,784 | 11/1962 | Thompson | 417/389 X |
| 3,440,970 | 4/1969 | Wagner | 417/394 |
| 3,507,583 | 4/1970 | James | 417/389 |
| 3,937,599 | 2/1976 | Thureau et al. | 417/389 |
| 4,008,008 | 2/1977 | Vergnet | 417/385 |
| 4,257,751 | 3/1981 | Kofahl | 417/394 |

FOREIGN PATENT DOCUMENTS

| | | | |
|---|---|---|---|
| 172795 | 2/1986 | European Pat. Off. | 417/387 |
| 84042381 | 2/1986 | Sweden . | |
| 566956 | 8/1977 | U.S.S.R. | 417/383 |
| 1221144 | 2/1971 | United Kingdom | 417/383 |

*Primary Examiner*—Leonard E. Smith
*Attorney, Agent, or Firm*—Young & Thompson

[57] ABSTRACT

A pump arrangement particularly intended for pumping water from deep wells, in which a feed pump unit (2) located at ground level transmits power and motion to delivery pump unit (3), so that during a working stroke of the pump arrangement water is raised through a delivery pipe (5) which is connected to the delivery pump unit (3) via a pressure valve (10), and in which during a return stroke of the pump arrangement water flows into the delivery pump unit through a well-water inlet pipe which is connected to the delivery pump unit via suction valve (11). In accordance with the invention a compressible and expandable chamber (6) in the feed pump unit (2) is connected to a similarly compressible and expandable chamber (7) in the delivery pump unit (3) by means of a hydraulic line (4), and the two chambers (6, 7) and the hydraulic line (4) together form a closed hydraulic system. A return spring (9) is arranged to support the compression of the chamber (7) or the delivery pump unit during the return stroke of the pump arrangement.

6 Claims, 6 Drawing Sheets

PUMP ARRANGEMENT, PARTICULARLY FOR PUMPING WATER FROM DEEP WELLS

BACKGROUND OF THE INVENTION

The present application relates to a pump arrangement which is particularly intended for raising water from deep wells and in which a feed pump unit located at ground level transmits power and motion to a water delivery pump unit so that during a working stroke of the pump, water is raised from a well bore to the mouth of a delivery pipe which is connected to the water delivery pump unit via a pressure valve, and in which arrangement water flows into the delivery pump unit during a return stroke of the pump through a well-water inlet connected to the delivery pump unit via a suction valve.

BRIEF DESCRIPTION OF THE PRIOR ART

Present day water pumps most often have the form of piston pumps, the pistons of which are located in the bottom of the well and connected through a draw rod to an auxiliary drive means located at ground level. Piston pumps intended for deep wells are heavy and cannot be readily handled. Furthermore, such pumps can be expensive to transport and to install. Since it is difficult to drill a truly vertical well hole, it is either necessary to overdimension the mouth of the well when using piston pumps, or to provide complicated guide means for the drill with which the well is bored, in order to ensure that the draw rod will be able to execute an essentially vertical reciprocating movement. Both of these measures are highly expensive.

It is also known to use in the present context compressible and expandable chambers which are lowered into the wall and which are connected through pressure conduits to an auxiliary activating device located at ground level. U.S. Pat. No. 4,008,008 teaches a pump of this kind, in which the auxiliary activating device for compressing and expanding the aforesaid chambers comprises a piston-type feed pump. It is necessary to install the feed pump in a readily accessible location so that seals can be easily replaced and the hydraulic system replenished with hydraulic fluid, as fluid is lost through seepage. In hot climates the hydraulic fluid present in the pump housing will therefore be exposed to high ambient temperatures, and there is a subsequent risk that when cooled during a pumping operation the hydraulic fluid will decrease in volume to an extent such as to render it difficult to maintain the working pressure desired.

It is also known to use compressed-air pumps and electrically-operated pumps in deep water wells. Such pumps, however, require access to external power sources, which may be an inconvenient requirement, particularly when working in the developing countries.

Since the lack of water is greatest in the developing countries, where the ground water is often located far beneath the surface of the ground, it is here that the greatest need for deep water wells is to be found. Because of the poor economy of developing countries, the cost factor is often totally decisive as to whether a well can be constructed or not.

In order for a deep water well to be constructed cheaply, it is necessary to use a pumping facility of such construction as to enable a drill hole of small dimensions to be used, and also to permit deviations from the vertical.

Furthermore, it should be possible to operate the pump arrangement manually, partly because the installation of auxiliary power sources and the transportation of fuel thereto often represents an insurmountable expense, and partly in order to keep care-and-maintenance work and repair work down to a minimum and to avoid the need for skilled maintenance personnel.

SUMMARY OF THE INVENTION

The present invention relates to a pump arrangement which while fulfilling all of the aforesaid requirements is not encumbered with the drawbacks found with manually operated piston pumps.

This object is achieved with a pump arrangement wherein the driving power is transmitted through a hydraulic line so that the need to drill the hole in which the pump arrangement is installed truly vertically is greatly decreased. Furthermore, lightweight plastic pipes can be used, thereby greatly reducing the cost of transportation in comparison with the costs entailed by conventional piston pumps.

The chambers in the feed pump unit and the delivery pump unit have the form of bellows-cylinders which provide a fully closed hydraulic system, thereby providing a pump arrangement which will not need to be replenished with hydraulic fluid and which enables the feed pump to be placed protectively beneath ground level.

BRIEF DESCRIPTION OF THE FIGURES

The aforementioned features of the invention together with additional features thereof and further advantages afforded thereby will be apparent from the following detailed description of exemplifying embodiments of the invention made with reference to the accompanying drawings, in which

FIGS. 4 and 5 also including horizontal cross-sectional views.

DETAILED DESCRIPTION

Figure 1:
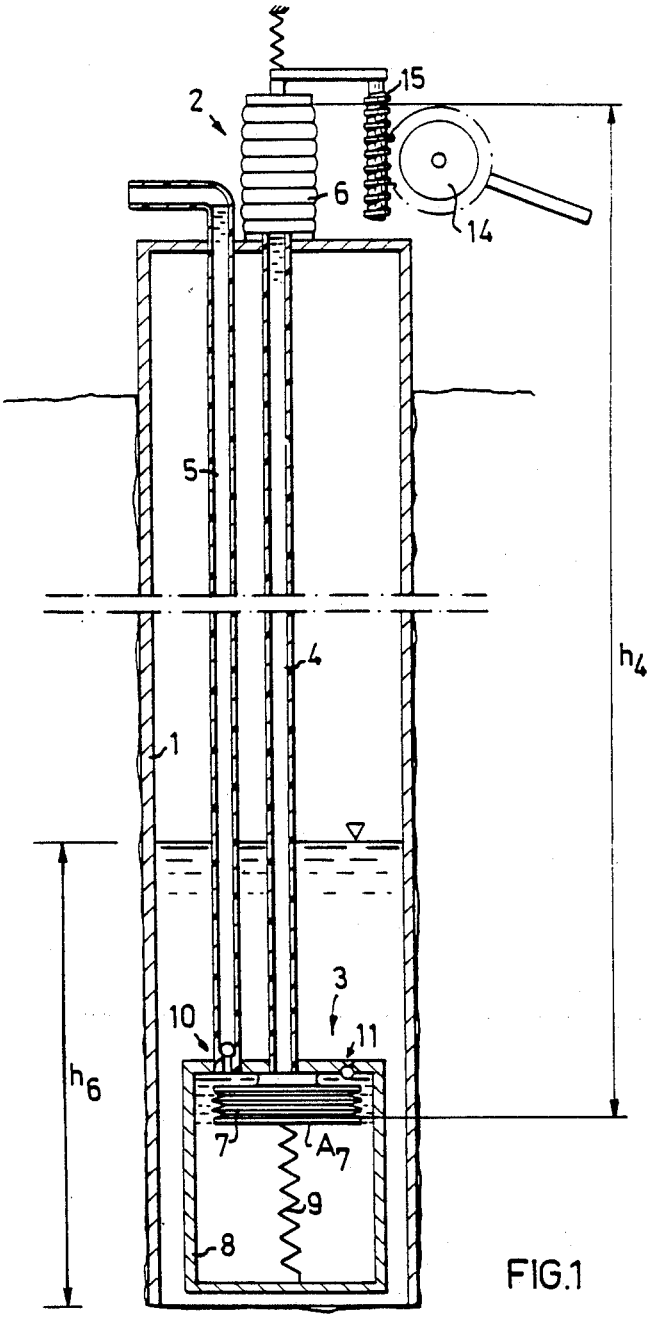
FIG. 1 is a schematic view, partly in cross-section, of a first embodiment of the pump arrangement according to the invention.

FIG. 1 illustrates schematically a pump arrangement constructed in accordance with the invention and enclosed by a well tube 1. The pump arrangement includes a feed pump unit 2, a delivery pump unit 3, an hydraulic line which connects the two pump units together, and a delivery pipe 5.

The main component of the feed pump unit comprises a compressible and expandable chamber 6, which comprises a bellows-cylinder provided with rigid end walls. The bellows-cylinder is connected at its upper end to an auxiliary drive mechanism (not shown in detail) which when activated causes the cylinder to move up and down. The auxiliary mechanism may be of any suitable kind and forms no part of the present invention. In view of the field of use for which the pump arrangement is intended, however, the auxiliary drive mechanism is preferably a manually operated system of simple construction with regard to maintenance. For example, the mechanism may conveniently comprise a lever-operated pinion 14 which drives a gear rack 15.

The lower end of the bellows-cylinder 6 is firmly secured in the feed pump unit 2 and the bottom surface of the cylinder has formed therein an opening which opens into the upper end of the hydraulic line 4 connected to the feed pump unit.

The delivery pump unit 3, which is placed close to the bottom of the well, also comprises a compressible and expandable chamber 7 in the form of a bellows-cylinder, the upper end of which is connected to the lower end of the hydraulic line 4. The bellows-cylinder 7 is enclosed in a pump housing 8 which incorporates connection openings to which the hydraulic line 4, the delivery pipe 5, and a well-water inlet pipe are respectively connected. The upper rigid end wall of the bellows-cylinder is firmly connected to the pump housing 8 by a stub pipe, so that the delivery pipe connection opening can be placed in the upper end wall of the pump housing. This positioning of the delivery pipe connection opening means that the space required in the cross direction of the pump arrangement need only slightly exceed the diameter of the bellows-cylinder 7. Any other positioning of the delivery pipe connection opening will require the delivery pipe to include a part that has an extension which lies outside the confines of the cross-dimensions of the pump housing.

A return spring 9 is arranged between the respective bottom walls of the bellows-cylinder 7 and the housing 8.

The pump arrangement operates as follows: during a working stroke the bellows-cylinder 6 is compressed through activation of the auxiliary drive mechanism. Since the bellows-cylinders 6, 7 and the hydraulic line 4 together form a closed hydraulic system, the decrease in the volume of the bellows-cylinder 6 as a result of its compression will be corresponded by an equally large increase in the volume of the bellows-cylinder 7, i.e. expansion of the cylinder. This results in the compression of the return spring 9 and in a pressure increase in the pump housing, which causes a pressure valve 10 located in the delivery pipe, in the proximity of its connection to the pump housing, to open. Simultaneously herewith, a volume of water equal to the increase in volume of the bellows-cylinder 7 is forced from the pump housing into the delivery pipe.

During the return stroke the bellows-cylinder 7 is compressed with the aid of the return spring 9. This reduction in volume of the bellows-cylinder results in a pressure decrease in the pump housing and causes therewith the pressure valve 10 to close and a suction valve 11 incorporated in the well-water inlet pipe to open. Water will thus flow from the well into the pump housing, in time with the compression of the bellows-cylinder 7. Subsequent to compressing the bellows-cylinder 7, a new working stroke is commenced, wherewith the pumping work is continued until the required amount of water has been delivered from the well.

The provision of a return spring 9 in accordance with the invention is necessary in order for the pump arrangement to function satisfactorily, since it is not possible to raise by underpressure a water column greater than 10 meters in height without the column collapsing. In order to compensate for the weight of the liquid column in the hydraulic line, the coil spring 9 must be pre-tensioned or biassed to a given extent, so that the bellows-cylinder 7 can be compressed to a maximum. When the hydraulic fluid used in the hydraulic system is water, a contemplated equilibrium with maximum compression of the bellows-cylinder 7 results in the following formula with regard to the biass or pre-tension embodied in the return spring 9.

$$F_O = \rho \cdot g \cdot A_7 (h_4 - h_b)$$

where $F_O$ = the pre-tension in the return spring 9

$\rho$ = the density of the fluid g = acceleration due to gravity $A_7$ = the bottom area of the chamber 7 of the delivery pump unit $h_4$ = the height of the hydraulic line $h_b$ = the level of the water in the well in relation to the bottom thereof.

During a working stroke the return spring 9 is compressed beyond the compression determined by the bias or pretension in the spring. Since the upper bellows-cylinder 6 is substantially free from external loads, it will be seen that strictly speaking the additional spring force generated when compressing the spring beyond its pretension $F_O$ is not needed for the spring to perform the work required during the return stroke. Consequently, the spring used is preferably one which presents within the stroke range of the bellows-cylinder 7 a characteristic which will produce the smallest possible spring force above the bias or pre-tension $F_O$.

In FIGS. 2–6 those parts of the pump arrangement illustrated therein that correspond to similar parts of the FIG. 1 embodiment have been identified with the same reference numerals preceded by 100.

Figure 2:
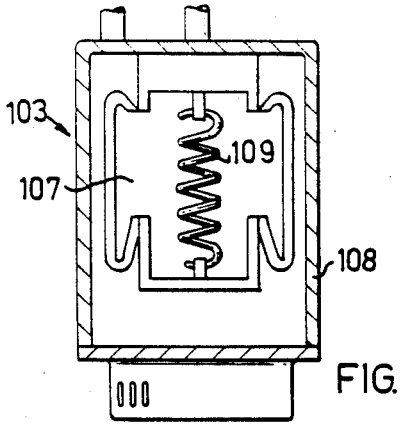
FIG. 2 is a sectional view of the delivery pump according to a second embodiment of the invention.

FIG. 2 illustrates a delivery pump unit which differs from the corresponding unit illustrated in FIG. 1, mainly in that the return spring 9 has been replaced with a draw or pull spring 109. This has resulted in a decrease in the axial extension of the housing 108 by an extent equal to the space that would have been occupied by a coil-type return spring in its compressed state.

Figure 3:
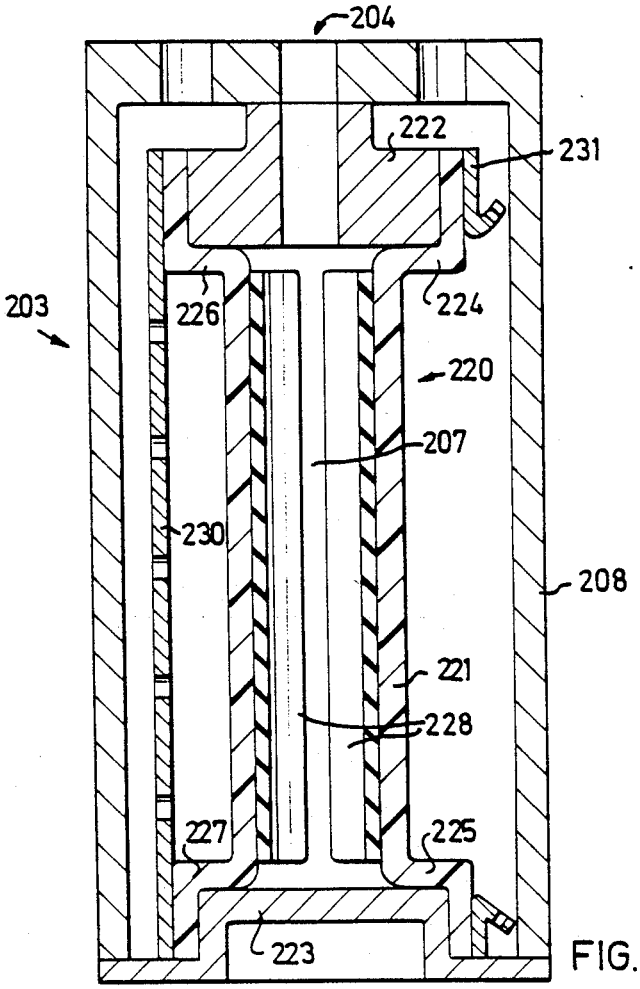
FIG. 3 is a sectional view of a third embodiment of a delivery pump unit according to the invention.

FIG. 3 illustrates a third embodiment of the invention. The delivery pump unit 203 of this embodiment includes a substantially radial expandable and compressible chamber 207 in the form of a bellows-cylinder generally referenced 220. The bellows-cylinder comprises a hose-like main part or body 221, the ends 224, 225 of which are firmly connected to a respective side edge of two disc-shaped holder elements 222 and 223, which in turn are firmly connected to the top and bottom parts respectively of the housing 208. The diameter of the disc-shaped holder elements is greater than the diameter of the hose-like main part 221, and the end connecting parts 226, 227 located between the ends 224, 225 firmly connected to the holder elements and adjoining parts of the main part 221 of the bellows-cylinder abut the end surfaces of the holder elements in the unloaded, relaxed state of the bellows-cylinder (the state illustrated in FIG. 3) and extend at right angles to the longitudinal direction of the main part 221.

As beforementioned, the delivery pump also includes a return spring. In the embodiment illustrated in FIG. 3 this spring is a rubber spring which comprises one or more rubber plates 228 joined to the hose-like main part or body 221 of the bellows-cylinder 220 in some suitable manner, e.g. vulcanized thereto. Although the rubber plates of the FIG. 3 embodiment are fastened to the inside of the bellows-cylinder, it will be understood that the plates may alternatively be fastened to the outside of said cylinder.

The hose-like body of the illustrative bellows-cylinder is made of an elastic material, for example reinforced rubber. Strictly speaking the hose-like body could itself form a return spring and the pretension obtained by expanding the hose-like body slightly from its relaxed or tensionless state, i.e. with a configuration shown in FIG. 3, to the unloaded position in the delivery pump unit by the pressure generated by the liquid column in the hydraulic line 204. However, since the end connecting parts 226, 227 merely offer but small resistance to expansion, only a small pressure is required to produce a relatively large increase in the volume of a hose-like body 221 in the absence of rubber springs applied thereto, since the hose-like body will then take an hour-glass configuration, which can be obtained solely by outwardly extending or dilating the ends of the hose-like body substantially without expanding the material therein. The available volume for expansion of the working stroke may be too small with such an embodiment.

By arranging a pre-tensioned rubber plate or plates 228 on the hose body, this plate (or plates) extending along the whole length of the main part 221 and, in the case of a plurality of plates, being uniformly distributed around the periphery of the main part 221, it is possible to achieve uniform resistance to expansion of the bellows-cylinder, because the resistance to bending of the main part 221 of the bellows-cylinder re-inforced with the rubber plates 228 will be greater than the roll-up resistance of the end connecting parts 226, 227. Consequently, expansion of the chamber 207 is effected essentially through radial dilation of the main part 221 of the hose body with the rubber plates 228 attached thereto.

By suitable reinforcement of the rubber plates 228, it is relatively simple to obtain selective bending resistance of the plates without increasing the resistanace to dilation in the radial direction. Naturally, selective resistance to bending of the hose-like main part 221 can be achieved in a similar manner, but since the whole of the hose-like body including the end connecting parts 226, 227 shall be formed integrally in one piece, it is not suitable from a manufacturing point of view to provide the hose-like body with inhomogenous reinforcements.

In the embodiment illustrated in FIG. 3, three rubber plates 228 are arranged uniformly around the circumference of the main part 221, although the rubber spring according to the invention may also comprise a single plate which extends around the whole of the periphery of the main part 221, or any number of uniformly distributed plates whatsoever.

In addition to providing a pre-tension force corresponding to the force $F_O$ in the return spring 9, an important function of the rubber spring in the delivery pump unit according to the invention is to ensure that when not subjected to load, the hose body will have the form illustrated in FIG. 3. The precise manner in which the chamber 207 expands during the working stroke to reach its ultimate expanded state is not important in this connection. On the other hand, it is important that the chamber 207 when in its ultimate expanded state takes up the largest possible volume. In order to prevent excessive increase in the roll-up resistance of the end connecting parts 226, 227, such that the part of the roll-up resistance which acts against deformation will prevent full expansion of the chamber 207 and the chamber obtain a balloon-like configuration in its ultimate expanded state, in which configuration the ends 224, 225 will prevent dilation of the parts 226, 227, it is suitable to ensure that expansion of the chamber is effected as a result of the ends of the main part 221 reaching the side wall of the housing 208 first. This permits continued expansion of the remaining parts of the main part 221, since the end connectng parts 226, 227 can be deformed and widened into the annular space located between the ends 224, 225 and the side wall of the housing 208 without an increase in resistance.

Thus, it may be suitable to provide for the desired expansion sequence by providing the hose-like main part 221 with locally separated bending resistances or spring characteristics. This can be achieved by, for example, replacing the rubber plates with rubber springs in the form of bands which have mutually different properties and which extend peripherally around the main part 221 and uniformly distributed along the axial length of the main part.

In this connection it can be mentioned that if the resistance to bending of the plate or plates 228 is of suitable magnitude, the desired expansion sequence can still be obtained, since the initial expansion of the chamber 207 from its unloaded or relaxed state takes place at the most readily dilated part, i.e. the end connecting parts 226, 227, which causes the main part 221 with plates 228 to bend and expand initially at the end parts, joining the parts 226, 227.

It will be understood that the return spring of the delivery pump unit may have forms other than those described and illustrated here. For example, the return spring may comprise two counter-directional, diagonally extending rubber bands which are joined together at their point of mutual intersection.

Neither need the hose-like body be made of a resilient material. The hose-like body or main part 221 can be given the bellows form illustrated in FIG. 3, by pleating or corrugating a flexible hose-like body, whereby the body is brought to its unpleated or uncorrugated expanded state solely against the action of the force exerted by the rubber springs. With this embodiment the hose-like body may be conveniently surrounded by a perforated cylinder 230 which determines or delimits the final expanded state of the hose-like body and which is illustrated on the left of FIG. 3. This cylinder will substantially prevent the occurrence of large tension forces in the hose-like body, irrespective of the working pressure applied thereto, which may be advantageous in certain applications.

On the right of FIG. 3 there is illustrated two holder rings 231, which have a form suitable for restricting the dilation of the end connecting parts 226, 227 in the ultimate expanded states of the hose-like body. Since these parts are dilated substantially solely as a result of the vertical reciprocating movement of said parts, without the material in said parts being subjected to appreciable tension forces, the ends 224, 225 of the hose-like body will be substantially free from load during the expansion sequence of the chamber, while the presence of the holder rings 231, prevents the occurrence of shear forces in the ends 224, 225 in the ultimate expanded state of the hose-like body.

Figure 4A:
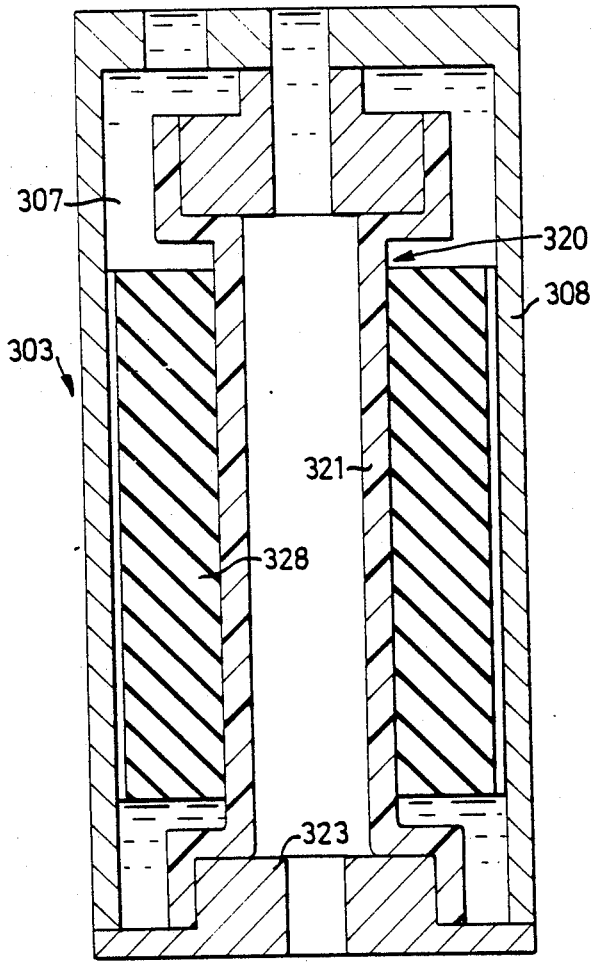
FIGS. 4–6 are sectional views of a delivery pump unit according to further embodiments of the invention.
Figure 4B:
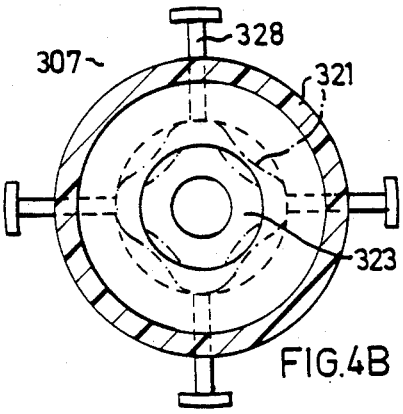

FIG. 4 illustrates another embodiment of a delivery pump unit according to the invention. In this embodiment the feed pump unit is connected to an annular chamber 307 which is defined by the wall of the housing 308 and the bellows-cylinder 320, wherewith pumping is achieved through a reduction in the central, cylindrical space within the hose-like body 321 of the cylinder, this reduction being caused by the expansion of the annular chamber 307. This expansion is counter-acted by radially projecting springs 328, preferably rubber springs, arranged peripherally around the hose-like body 321. As illustrated in chain lines in the horizontal cross-section shown in FIG. 4B, the section of the hose body located between the peripherally spaced springs 328 will be slightly dilated or expanded in the unloaded state of the chamber 307, i.e. when the pressure prevailing in the chamber solely balances the hydraulic-fluid column in the hydraulic line between the feed pump unit and the delivery pump unit. When the hose-like body is fully expanded it will have an hour-glass configuration. Both of these properties restrict the possible expansion volume of the chamber 307 in relation to the uniform radial dilation according to the embodiment illustrated in FIG. 3, and hence the dimensions of the delivery pump unit 303 will be greater than those of a delivery pump unit 203 of the same stroke volume.

Figure 5A:
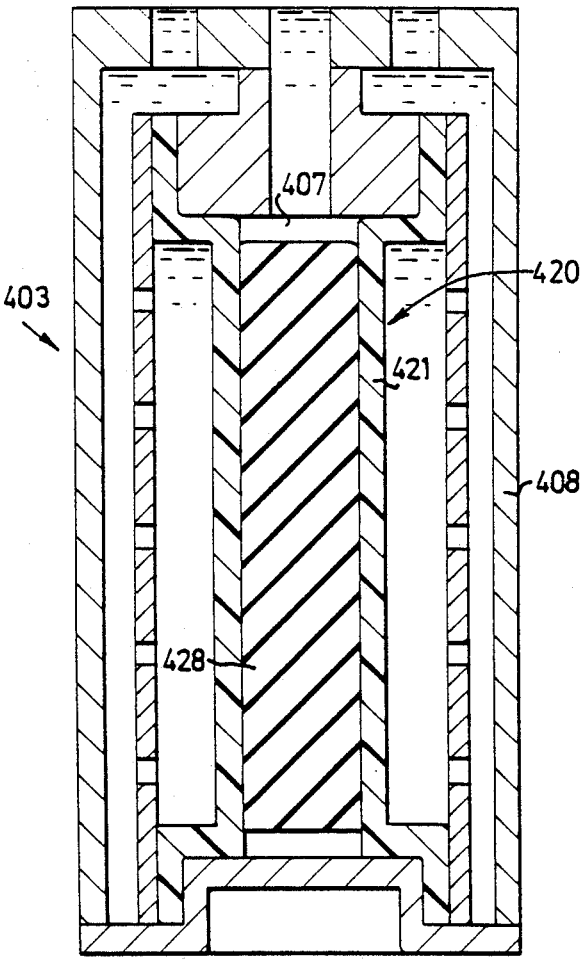
Figure 5B:
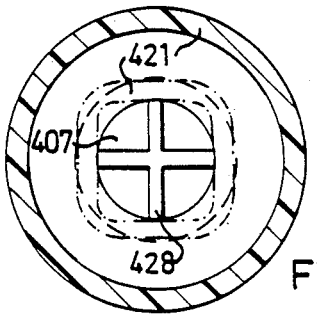

In the embodiment illustrated in FIG. 5 the chamber 407 connected to the feed pump unit comprises the interior of the hose-like body. The return springs also have a radial extension in this embodiment. As opposed to the embodiment illustrated in FIG. 3, the end connecting parts of the bellows-cylinder 420 are also firmly connected to the horizontal parts of the holder elements, thereby preventing the bellows 420 from taking an hour-glass configuration in the unloaded state of the bellows. Consequently, in their dilated state the bellows will obtain a balloon-like configuration. The springs of the FIG. 5 embodiment comprise two rubber plates 428 which cross one another centrally of the hose-like body. This embodiment is advantageous from the point of view of manufacture, since the hose-like body and springs can be manufactured as a single-piece structure. Naturally, the return spring may comprise more than two rubber plates.

Figure 6:
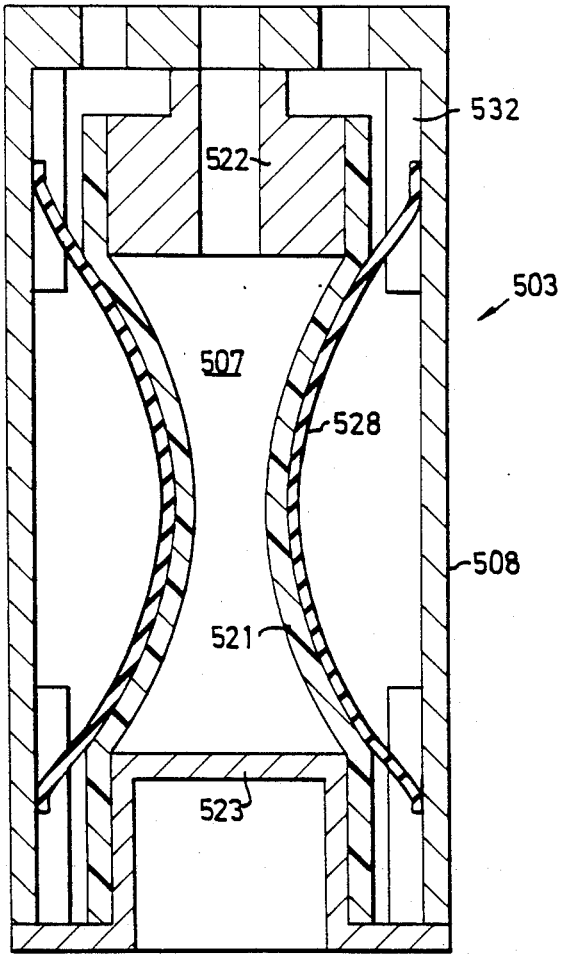

As mentioned earlier in the description, the springs shall, in principle, solely balance the pressure exerted by the hydraulic-fluid column in the hydraulic line between the feed pump unit and the delivery pump unit. This becomes more important with increasing well depths, due to the large spring forces which otherwise must be overcome. FIG. 6 illustrates an embodiment which is particularly advantageous in this connection.

The return springs of this embodiment comprise frictionless leaf springs 528, which are preferably made of beryllium. The springs are attached along their major part in the hose-like body 521, and the ends of the springs reach to the inner wall of the housing 508. These ends are guided in radially protruding pairs of guide plates 532 on the housing, of which the one plate of a guide-plate pair is illustrated in FIG. 6. When the chamber 507 expands, the only deformation undergone by the springs is a decrease in the curvatuve thereof, which causes the spring ends to slide against the housing wall in respective pairs of guide plates 532. The resistance of the springs to deformation is substantially constant during the whole of the expansion sequence of the chamber 507, and hence pumping can be effected with a force which only slighgtly exceeds the pre-tensioning force. A plurality of leaf springs 528 can be placed peripherally around the hose-like body 521, without appreciably influencing the available stroke volume, which enables the hose-like body in this case to be made advantageously of a non-elastic but flexible material, and hence the hose-like body will not present any resistance to expansion either.

In the embodiments illustrated in FIGS. 3–6, the delivery pump units are dimensioned for one single depth, whereas the pump unit illustrated in FIG. 2 can be used at different depths, by replacing the spring 109 with another spring of suitable characteristics.

Figure 7:
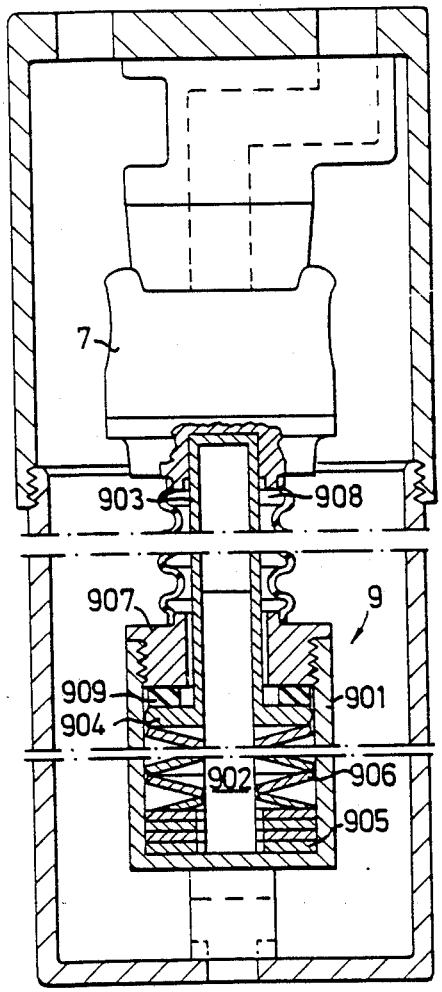
FIG. 7 is a sectional view of one embodiment of a spring device suitable for use in a pump arrangement according to FIG. 1.

FIG. 7 illustrates a spring device shown generally at 9 which can be used to particular advantage together with a bellows-cylinder 7 for drill holes whose depths are not known when manufacturing the pump according to the invention. The spring device 9 includes a spring housing 901, which comprises a cylindrical body having a closed bottom and an upper, open end, which is provided with a screw thread. Extending vertically upwards from the centre of the housing bottom is a guide pin 902 on which a guide tube 903 is slideably guided. The upper end of the guide tube is connected to the bottom of the bellows-cylinder 7. The guide tube has a radial, annular flange 904 provided at its lower end. Arranged between the lower end of the guide tube and the bottom of the housing are spacer rings 905 and belleville washers 906. The cup springs are arranged to exert a desired pre-tensioning force against the annular flange 904. It will be seen that the pre-tensioning force can be varied within relatively wide limits, through suitable selection of the number of belleville washers and spacer rings used, and by suitable stacking of the belleville washers. The upper, open end of the housing 901 is closed by a plug 907 which incorporates a hole through which the guide pin 902 and the guide tube 903 can pass. The interior of the spring housing is sealed against the surroundings with the aid of a bellows-seal 908, while a resilient impact-dampening ring 909 is arranged on the underside of the plug 907. The space defined by the guide tube 903 above the guide pin 902 is ventilated in some suitable manner, i.e. is caused to communicate with the interior of the housing 901, for example through a channel provided in the guide pin.

One important advantage afforded by the embodiment illustrated in FIG. 7, is that the guide pin 902 and the guide tube 903 will ensure that the movement of the bottom surface of the bellows-cylinder 7 is accurately guided, thereby enabling a bellows-cylinder that has a long working stroke to be used, for example a bellows-cylinder of the roller diaphragm type, which is particularly important in the case of drill holes of very small diameter, in order to be able to obtain a sufficiently large volumetric flow. Because the spring housing and the guide tube are sealed against the surroundings, it is possible to manufacture the springs and the bellows guide means from a non-stainless material, and a one-time maintenance lubricant, such as molybdenum disulphide, will remain active for a long period of time, which results in a very small frictional effect during operation.

The pre-tension produced in the spring packet by the configuration illustrated in the Figure can be reduced by unscrewing the plug 907 slightly, provided that the bellows-cylinder 7 will enable the upper end of the guide tube 903 to move upwardly to a corresponding extent. This facility can be utilized to enable fine adjustments to be made to the pre-tensioning force, by constructing the housing so that it can be displaced vertically and by making the screw joint between housing and plug active for a relatively large degree of axial movement of the plug in relation to the housing. The use of belleville washers enables the pre-tensioning force to be varied readily with mutually different depths. Furthermore, the aforedescribed package or assembly of belleville washers may be shorter than a coil spring of corresponding bias, which is an important advantage from a handling aspect. Finally, the inventive package of belleville washers is protected against damage from without, i.e. from the often aggressive well water, and hence will have a long useful life, which is an important contribution in the field of use for which the invention is intended.

A number of modifications are conceivable within the scope of the invention. The scope of the invention is not therefore solely restricted by the content of the following claims.

I claim:

1. In a pump arrangement for pumping water from deep wells including a feed pump unit (2) located at ground level which transits power and motion to a delivery pump unit (3) to raise water through a delivery pipe (5) connected to the delivery pump unit via a pressure valve (10) during a working stroke and to draw water into the delivery pump unit through a well-water inlet pipe via a suction valve (11) during a return stroke, the improvement which comprises (a) a closed hydraulic system connecting said feed pump unit with said delivery pump unit, comprising
  (1) a first compressible and expandable chamber (6) arranged in said feed pump unit;
  (2) a second compressible and expandable chamber (7) arranged in said delivery pump unit; and
  (3) a hydraulic line (4) hydraulically connected said first and second chambers; and (b) return spring means (9) for supporting compression of said second chamber during the return stroke, said return spring means including
  (1) a housing (901) open at its upper end, said upper housing end being connected in sealed relation with the bottom of said second chamber;
  (2) a longitudinal member (903) connected with the bottom of said second chamber and vertically displaceable within said housing upon compression and expansion of said second chamber;
  (3) a plurality of belleville washers (906) arranged in stacked relation within said housing and supporting the bottom of said longitudinal member, said stack of washers providing a pretensioning force to said second chamber via said longitudinal member in accordance with the number of washers in said stack, said sealed housing preventing contaminants from contacting said longitudinal member and said washers to ensure smooth operation and a long life of said pump.

2. A pump arrangement according to claim 1, characterized in that the return spring (9) has a pre-tension ($F_O$) which at least balances the weight exerted by a liquid column in the hydraulic line (4).

3. A pump arrangement according to claim 2, characterized in that the pre-tension ($F_O$) of the return spring (9) is determined by the following formula:

$$F_O = \rho \cdot g(h_4 - h_b) \cdot A_7$$

where $\rho$ = the liquid density g = acceleration due to gravity $h_4$ = the height of the hydraulic line $h_b$ = level difference between the bottom of the chamber of the delivery pump unit and the level of water in the well $A_7$ = the bottom area of the chamber of the delivery pump unit.

4. A pump as defined in claim 1, wherein said housing comprises a lower rigid portion and an upper bellows seal portion (908).

5. A pump as defined in claim 4, wherein said return spring means further comprises a plurality of spacer plates (905) arranged in stacked relation on said housing bottom for supporting said stack of belleville washers, said pre-tensioning force being varied in accordance with the number of washers and plates in said stacks, respectively.

6. A pump as defined in claim 5, wherein said return spring means further comprises a vertical guide pin (902) arranged within said housing, said longitudinal member containing a longitudinal bore for receiving said guide pin, whereby said pin guides said member to control vertical displacement thereof.

* * * * *

UNITED STATES PATENT AND TRADEMARK OFFICE

CERTIFICATE OF CORRECTION

PATENT NO. : 4,822,257

DATED : Apr. 18, 1989

INVENTOR(S) : Björn Olofsson

It is certified that error appears in the above-identified patent and that said Letters Patent is hereby corrected as shown below:

On the title page, under item [30], "86002244" should read --8602244--.

Signed and Sealed this

Ninth Day of January, 1990

*Attest:*

JEFFREY M. SAMUELS

*Attesting Officer*

*Acting Commissioner of Patents and Trademarks*